US005116572A

United States Patent [19]

Narayanan et al.

[11] Patent Number: 5,116,572

[45] Date of Patent: May 26, 1992

[54] ALUMINUM-LITHIUM ALLOY

[75] Inventors: G. Hari Narayanan, Seattle; R. Eugene Curtis, Issaquah; William E. Quist, Redmond; Michael V. Hyatt; Sven E. Axter, both of Bellevue, all of Wash.

[73] Assignee: The Boeing Company, Seattle, Wash.

[21] Appl. No.: 401,565

[22] Filed: Aug. 28, 1989

Related U.S. Application Data

[63] Continuation of Ser. No. 788,541, Aug. 20, 1985, abandoned, which is a continuation-in-part of Ser. No. 492,367, Mar. 9, 1990, which is a continuation of Ser. No. 94,015, Sep. 4, 1987, abandoned, which is a continuation of Ser. No. 701,124, Feb. 13, 1985, abandoned, which is a continuation-in-part of Ser. No. 567,356, Dec. 30, 1983, abandoned.

[51] Int. Cl.[5] ..... C22C 21/12

[52] U.S. Cl. ..... 420/533; 420/534; 420/535; 148/439

[58] Field of Search ..... 420/533, 534, 535; 148/439

[56] References Cited

U.S. PATENT DOCUMENTS

| | | | |
|---|---|---|---|
| 2,381,219 | 8/1945 | LeBaron | 420/529 |
| 2,915,391 | 12/1959 | Criner | 420/533 |
| 4,626,409 | 12/1986 | Miller | 420/533 |
| 4,806,174 | 2/1989 | Cho et al. | 148/439 |
| 4,861,551 | 8/1989 | Meschter et al. | 420/533 |

OTHER PUBLICATIONS

Starke, E. A., Jr., et al., *Journal of Metals*, 33(8):24–33, 1981.

Lin, F. S., et al., *Metallurgical Transactions A* 13A:4-01–410, 1982.

Noble, B., and G. E. Thompson, "$T_1(Al_2CuLi)$ Precipitation in Aluminium–Copper–Lithium Alloys," Metal Science Journal 6:167–174, 1972.

Kar, R. J., et al., "Correlation of Microstructures, Aging Treatments, and Properties of Al–Li–Cu–Mg–Zr I/M and P/M Alloys," in Proceedings of the Second International Aluminum–Lithium Conference, Apr. 12–14, 1983, Monterey, California, E. A. Starke, Jr. and T. H. Sanders, Jr. (Eds.), The Metallurgical Society of AIME, Warrendale, PA, pp. 255–285, 1984.

*Primary Examiner*—Deborah Yee

*Attorney, Agent, or Firm*—Christensen, O'Connor, Johnson & Kindness

[57] ABSTRACT

An aluminum-lithium alloy exhibiting good fracture toughness and relatively high strength has a nominal composition of 2.2 percent lithium, 0.6 percent magnesium, 2.5 percent copper, 0.12 percent zirconium with the balance being aluminum and trace elements.

15 Claims, No Drawings

ALUMINUM-LITHIUM ALLOY

This application is a continuation of U.S. patent Ser. No. 07/788,541 filed Aug. 20, 1985, now abandoned which is a continuation-in-part of U.S. patent Ser. No. 07/492,367 filed Mar. 9, 1990, now pending which is a continuation of U.S. patent Ser. No. 07/094,015 filed Sep. 4, 1987, now abandoned which is a continuation of U.S. patent Ser. No. 06/701,124 filed Feb. 13, 1985, now abandoned which is a continuation-in-part of U.S. patent Ser. No. 06/567,356 filed Dec. 30, 1983, now abandoned.

BACKGROUND OF THE INVENTION

The present invention relates to aluminum-lithium alloys and more particularly to an aluminum-lithium alloy composition with good fracture toughness and high strength.

It has been estimated that current large commercial transport aircraft may be able to save from 15 to 20 gallons of fuel per year for every pound of weight that can be saved when building the aircraft. Over the projected 20 years life of an airplane, this savings amounts to 300 to 400 gallons of fuel. At current fuel costs, a significant investment to reduce the structure weight of the aircraft can be made to improve overall economic efficiency of the aircraft.

The need for improved performances in aircraft of various types can be satisfied by the use of improved engines, improved airframe design, and improved or new structural materials in the aircraft. The development of new and improved structural materials has recently received increased attention and is expected to yield significant gains in performance.

Materials have always played an important role in dictating aircraft structural concepts. In the early part of this century, aircraft structure was composed of wood, primarily spruce, and fabric. Because shortages of spruce developed in the early part of the century, lightweight metal alloys began to be used as aircraft structural materials. At about the same time, improvements in design brought about the development of the all metal cantilevered wing. It was not until the 1930's, however, that the metal skin wing design became standard, and firmly established metals, primarily aluminum alloys, as the major airframe structural material. Since that time, aircraft structural materials have remained remarkably consistent with aluminum structural materials being used primarily in the wing, body and empennage, and with steel comprising the material for the landing gear and certain other specialty applications requiring very high strength materials.

Several new materials are currently being developed for incorporation into aircraft structure. These include new metallic materials, metal matrix composites and resin matrix composites. It is believed that improved aluminum alloys and carbon fiber composites will dominate aircraft structural materials in the coming decades. While composites will be used in increased percentages as aircraft structural materials, new low-density aluminum alloys, and especially aluminum-lithium alloys show great promise for extending the use of aluminum alloys in aerospace structures.

Heretofore, aluminum-lithium alloys have been used only sparsely in aircraft structure. The relatively low use has been caused by casting difficulties associated with aluminum-lithium alloys and by their relatively low fracture toughness compared to other more conventional aluminum alloys. Lithium additions to aluminum alloys, however, provide a substantial lowering of the density as compared to conventional aluminum alloys, which has been found to be very important in decreasing the overall structural weight of aircraft. Lithium additions are also effective in achieving a relatively high strength to weight ratio. While substantial strides have been made in improving the aluminum-lithium processing technology, a major challenge still outstanding is an ability to obtain a good blend of fracture toughness and high strength in an aluminum-lithium alloy.

SUMMARY OF THE INVENTION

The present invention provides a novel aluminum alloy composition that can be worked and heat treated so as to provide an aluminum-lithium alloy with high strength, good fracture toughness, and relatively low density compared to conventional aluminum alloys such as 7XXX and 2XXX series alloys that it is intended to replace. An alloy prepared in accordance with the present invention has a nominal composition on the order of 2.2 weight percent lithium, 0.6 percent magnesium, 2.5 percent copper, and 0.12 percent zirconium. Artificial aging of the alloy at a temperature in the range of 250° to 350° F. to a near-peak age condition results in high strengths comparable to those of current 7XXX-T6 alloys in combination with good toughness and resistance to stress corrosion cracking. By underaging the alloy, strength and fracture toughness levels equivalent to or better than those of existing 2XXX-T3 type alloys are obtained. Considerable improvement in the already excellent combination of fracture toughness and high strength is achieved for both 7XXX and 2XXX applications by underaging the alloy within the relatively low temperature range of 250° to 300° F.

DETAILED DESCRIPTION OF THE INVENTION

An aluminum-lithium alloy formulated in accordance with the present invention can contain from about 2.0 to about 2.4 percent lithium, 0.3 to 0.9 percent magnesium, 2.1 to 2.9 percent copper, and from about 0.08 to a maximum of 0.15 percent zirconium as a grain refiner. Preferably from about 0.09 to 0.14 percent zirconium is incorporated. All percentages herein are by weight percent based on the total weight of the alloy unless otherwise indicated. The magnesium is included to increase strength without increasing density. Preferred amounts of magnesium range from about 0.4 to 0.8 percent, with 0.6 percent being most preferred. The copper adds strength to the alloy.

Iron and silicon can each be present in maximums up to a total of 0.3 percent. It is preferred that these impurities be present only in trace amounts, limiting the iron to a maximum of 0.15 percent and the silicon to a maximum of 0.12 percent, and preferably to maximums of 0.10 and 0.10 percent, respectively. The element zinc may be present in amounts up to but not exceeding 0.25 percent of the total. Titanium and chromium should not exceed 0.15 percent and 0.10 percent, respectively. Other elements such as manganese must each be held to levels of 0.05 percent or below, and the total amount of such other trace elements must be held to a maximum 0.15 percentage. If the foregoing maximums are exceeded the desired properties of the aluminum-lithium alloy will tend to deteriorate. The trace elements sodium and hydrogen are also thought to be harmful to the properties (fracture toughness in particular) of aluminum-lithium alloys and should be held to the lowest levels practically attainable, for example on the order of 15 to 30 ppm (0.0015–0.0030 wt. %) or less for the sodium and less than 15 ppm (0.0015 wt. %) and preferably less than 1.0 ppm (0.0001 wt. %) for the hydrogen. The balance of the alloy, of course, comprises aluminum.

An aluminum-lithium alloy formulated in the proportions set forth in the foregoing two paragraphs is processed into an article utilizing known techniques. The alloy is formulated in molten form and cast into an ingot. The ingot is then homogenized at temperatures ranging from 925° to 1010° F. or higher. Thereafter, the alloy is converted into a usable article by conventional mechanical formation techniques such as rolling, extrusion, or the like. Once an article is formed, the alloy is normally subjected to a solution treatment at temperatures ranging from 950° to 1010° F., followed by quenching in a quenching medium such as water that is maintained at a temperature on the order of 70° to 150° F. If the alloy has been rolled or extruded, it is generally stretched on the order of 1 to 3 percent of its original length to relieve internal stresses, and to provide improved age hardening response.

The aluminum alloy can then be further worked and formed by secondary operations into the various shapes for its final application. Additional heat treatments such as solution heat treatment and/or aging can be employed if desired after such forming operations. For example, sheet products after stretch forming to the desired shapes may be re-solution heat treated at a temperature on the order of 995° F. for 10 minutes to one hour. The article is normally then quenched in a quenching medium held at temperatures ranging from about 70° to 150° F.

Thereafter, in accordance with the present invention, the alloy is subjected to an aging treatment at moderately low temperatures on the order of from 250° to 350° F.

When this alloy is intended to replace conventional 7XXX series type alloys, the alloy can be aged for a period of time that will allow it to achieve near peak strength, preferably about 95 percent, and most preferably about 95 to 97 percent, of its peak strength. Preferred aging temperatures for this purpose range from 275° to 325° F. Within these temperature ranges, 95 to 97 percent peak age can be achieved by aging for about 4 to 120 hours, and preferably for about 24 to 96 hours.

When this alloy is intended to replace conventional 2XXX series alloys, the alloy can be aged to achieve moderately high strength in conjunction with high fracture toughness. Preferred aging temperatures for this purpose range from about 250° to 300° F., more preferably from about 250° to 275° F., and most preferably on the order of 250° F. Within these temperature ranges, moderately high strength in conjunction with high fracture toughness can be achieved by aging for about 4 to 48 hours, and preferably about 4 to 24 hours.

An alternative way to achieve 2XXX series alloy properties is to naturally age the alloy, after quenching, for periods of four to seven days. Ultimate strength values of approximately 65 ksi are developed in plate products together with yield strengths of about 55 ksi. In addition, outstanding fracture toughness and ductility properties are developed in both longitudinal and transverse grain directions.

EXAMPLE

The following example is presented to illustrate the significantly improved and unexpected characteristics of an aluminum-lithium alloy formulated and manufactured in accordance with the parameters of the present invention. Moreover, it is intended to illustrate the superior characteristics of this aluminum-lithium alloy when aged in accordance with the present invention and to assist one of ordinary skill in making and using the present invention. The following example is not intended in any way to otherwise limit the scope of this disclosure or the protection granted by Letters Patent hereon.

An aluminum alloy containing 2.2 percent lithium, 0.62 percent magnesium, 2.5 percent copper, 0.09 percent zirconium with the balance being aluminum was formulated. The trace elements present in the formulation constituted less than 0.25 percent of the total. The iron and silicon present in homogenized at about 975° F. Thereafter, the alloy was extruded to a thickness of 0.75 inches. The resulting extrusion was then solution treated at about 975° F. for about 90 minutes. The extrusion was then quenched in water maintained at about 70° F. Thereafter, the extrusion was subjected to a stretch of about 1½ percent of its initial length. The material was than cut into specimens for fracture toughness (precracked Charpy impact test) and tensile strength testing. The precracked Charpy impact test specimens were machined to a final specimen size of 0.394×0.394×2.16 inches. The specimens prepared for tensile strength tests were standard round specimens having a gauge section diameter of 0.25 inches. A plurality of specimens were then artificially aged for up to 72 hours at 300° F. to a near-peak age condition, In addition, a second set of tensile and Charpy specimens were aged at 275° F. for eight hours to a considerably underaged condition. The specimens were then subjected to tensile strength and precracked Charpy impact tests in accordance with standard ASTM and industry testing procedures. The specimens aged at 300° F. to a near-peak age condition exhibited ultimate strengths ranging on the order of 82 to 92 ski with fracture toughness values on the order of 220 to 350 in-lbs/in$^2$. By comparison, the specimens underaged at 275° developed a very high fracture toughness, on the order of 650 to 850 in-lbs/in$^2$, in combination with ultimate strengths in the range of 70 to 75 ksi.

The present invention has been described in relation to various embodiments, including the preferred formulation and processing parameters. One of ordinary skill after reading the foregoing specification will be able to effect various changes, substitutions of equivalents, and other alterations without departing from the broad concepts set forth herein. It is therefore intended that the scope of the Letters Patent granted hereon will be limited only by the definition contained in the appended claims and equivalents thereof.

The embodiments of the invention in which an exclusive property or privilege is claimed are defined as follows:

1. An aluminum-lithium alloy exhibiting good fracture toughness consisting essentially of:

| Element | Amount (wt. %) |
|---|---|
| Li | 2.0 to 2.4 |
| Mg | 0.3 to 0.9 |
| Cu | 2.1 to 2.9 |

-continued

| Element | Amount (wt. %) |
|---|---|
| Zr | 0.08 to 0.15 |
| Fe | 0.15 max |
| Si | 0.12 max |
| Zn | 0.25 max |
| Ti | 0.15 max |
| Cr | 0.1 max |
| Other trace elements, each | 0.05 max |
| Other trace elements, total | 0.15 max |
| Al | Balance. |

2. The alloy of claim 1 wherein said zirconium is present in amounts from about 0.09 to 0.14 percent.

3. The alloy of claim 1 wherein said magnesium is present in an amount ranging from about 0.4 to 0.8 percent.

4. The alloy of claim 1 having a nominal composition of 2.2 percent lithium, 0.6 percent magnesium, 2.5 percent copper, and 0.12 percent zirconium.

5. The alloy of claim 1 wherein said alloy has been aged at a moderately low temperature to near peak strength.

6. The alloy of claim 1 wherein said alloy has been aged at a temperature in the range of from 250° to 350° F.

7. The alloy of claim 6 aged at a temperature in the range of from 275° to 325° F.

8. The alloy of claim 6 aged for 4 to 120 hours.

9. The alloy of claim 7 aged for 24 to 96 hours.

10. The alloy of claim 6 aged at a temperature in the range of 250° to 300° F.

11. The alloy of claim 10 aged at a temperature in the range of 250° to 275° F.

12. The alloy of claim 11 aged at a temperature on the order of 250° F.

13. The alloy of claim 10 aged for about 4 to 48 hours.

14. The alloy of claim 13 aged for about 4 to 24 hours.

15. The alloy of claim 1 wherein said alloy has been naturally aged.

* * * * *

UNITED STATES PATENT AND TRADEMARK OFFICE

CERTIFICATE OF CORRECTION

PATENT NO. : 5,116,572

DATED : May 26, 1992

INVENTOR(S) : G.H. Narayanan et al.

It is certified that error appears in the above-identified patent and that said Letters Patent is hereby corrected as shown below:

| COLUMN | LINE | ERROR |
|---|---|---|
| 1, | 17 | "alloys.and" s/r --alloys and-- |
| 1, | 24 | "years" s/r --year-- |
| 1, | 29 | "performances" s/r --performance-- |
| 4, | 19 | after "present in" insert --the formulation constituted 0.10 percent each. The alloy was cast and-- |
| 4, | 42 | "92 ski" s/r --92 ksi-- |

Signed and Sealed this

Third Day of August, 1993

*Attest:*

Michael K. Kirk

MICHAEL K. KIRK

*Attesting Officer*

*Acting Commissioner of Patents and Trademarks*